US006093447A

United States Patent [19]

Johnson et al.

[11] Patent Number: 6,093,447

[45] Date of Patent: Jul. 25, 2000

[54] MORDANTING SUBSTRATES AND AGENTS

[75] Inventors: Edward J. Johnson, Arlington; Donald R. Allred, Westford, both of Mass.

[73] Assignee: Iris Graphics, Inc., Bedford, Mass.

[21] Appl. No.: 08/910,577

[22] Filed: Jul. 18, 1997

Related U.S. Application Data

[63] Continuation of application No. 08/552,597, Nov. 3, 1995, abandoned.

[51] Int. Cl.[7] ..... B41J 2/01; B05D 5/04

[52] U.S. Cl. ..... 427/146; 347/105; 428/195; 428/304.4

[58] Field of Search ..... 428/195, 211, 428/534, 304.4; 162/164.1, 164.6, 168.1, 168.2, 177; 347/105; 427/146

[56] References Cited

U.S. PATENT DOCUMENTS

| | | | |
|---|---|---|---|
| 3,773,509 | 11/1973 | Ohyama et al. . | |
| 4,209,449 | 6/1980 | Mayhew et al. . | |
| 4,314,001 | 2/1982 | Wesseler . | |
| 4,322,489 | 3/1982 | Land et al. . | |
| 4,347,352 | 8/1982 | Wesseler . | |
| 4,396,698 | 8/1983 | Karino et al. . | |
| 4,463,080 | 7/1984 | Snow et al. . | |
| 4,502,002 | 2/1985 | Ando . | |
| 4,542,125 | 9/1985 | Gorman et al. | 514/57 |
| 4,554,181 | 11/1985 | Cousin et al. . | |
| 4,766,015 | 8/1988 | Nikoloff et al. . | |
| 4,814,255 | 3/1989 | Venmaele et al. . | |
| 4,925,530 | 5/1990 | Sinclair et al. | 162/164.1 |
| 4,970,250 | 11/1990 | Martinez et al. | 524/145 |
| 5,004,659 | 4/1991 | Vermeulen et al. . | |
| 5,106,416 | 4/1992 | Moffatt et al. . | |
| 5,116,409 | 5/1992 | Moffatt . | |
| 5,126,010 | 6/1992 | Kobayashi et al. . | |
| 5,302,437 | 4/1994 | Idei et al. . | |
| 5,342,688 | 8/1994 | Kitchin et al. . | |
| 5,403,362 | 4/1995 | Gurley . | |
| 5,403,955 | 4/1995 | Farooq . | |
| 5,418,078 | 5/1995 | Desie et al. . | |
| 5,474,843 | 12/1995 | Lambert et al. | 428/195 |

FOREIGN PATENT DOCUMENTS

| | | |
|---|---|---|
| A365726 | 5/1990 | European Pat. Off. . |
| A495591 | 7/1992 | European Pat. Off. . |
| A620315 | 10/1994 | European Pat. Off. . |
| A0673779 | 9/1995 | European Pat. Off. . |
| A2605934 | 5/1988 | France . |
| A31312248 | 6/1982 | Germany . |
| 63-307979 | 12/1988 | Japan . |
| 5209377 | 8/1993 | Japan . |

OTHER PUBLICATIONS

Fost, "Multifunctional Biomimetic Phospolipids: Their Applications in Personal Care", Cosmetics and Toiletries Manufacture Worldwide, 83–89, 1994.

Phospholipid EFA, Technical Bulletin, No. 1016b, 2 pages, 1993.

Phospholipid PTC, Technical Bulletin, No. 1019b, 1 page, 1994.

Phospholipid SV, Technical Bulletin, No. 1018B, 1 page, 1994.

Phospholipid CDM, Technical Bulletin, No. 1057, 1 page, 1994.

Phospholipid GLA, Technical Bulletin, No. 1059, 1 page, 1994.

Oka et al., "The Physicochemical Enviroment of Acid Red 249 Insolubilized in an Ink–Jet Paper," J. of Imaging Science and Technology 39:239–243, 1995.

Amerchol, Ucare® Polymers: Conditioners for All Conditions, 6 pages.

*Primary Examiner*—Pamela R. Schwartz

*Attorney, Agent, or Firm*—Fish & Richardson P.C.

[57] ABSTRACT

A mordanting substrate is provided including a porous substrate, and, distributed within the substrate, a mordanting agent. Preferably, the substrate is a fibrous cellulosic material, and the mordanting agent is a cationic polymer that is soluble in polar solvents, preferably water-soluble. The polar solvent solubility of the polymer, in combination with the porosity and cellulosic nature of the material, has been found to cause the mordanting agent, when imbibed into the substrate in the form of a solution, to bind to fibers within the substrate. This binding in turn allows excellent immobilization of dye within the substrate.

5 Claims, No Drawings

MORDANTING SUBSTRATES AND AGENTS

This application is a continuation of application Ser. No. 08/552,597, filed Nov. 3, 1995, now abandoned.

BACKGROUND OF THE INVENTION

The invention relates to mordanting substrates and mordanting agents.

Ink jet printing is a non-impact printing system which transfers ink droplets, usually of aqueous ink, from a printhead to a substrate. One important application for ink jet technology is high quality printing, e.g., printing of fine art reproductions or proofs, as ink jet printing is capable of producing near photographic quality imaging due to its use of small dots and high resolution. In high quality printing (and, to a lesser extent, in other ink jet applications) it is important to obtain high color density and limited dot spreading (also referred to as "dot gain").

Dot spreading has been limited by providing an ink-receptive surface layer on the ink jet substrate. These surface layers typically include a film-forming binder, a mordanting agent, silica and/or clays, and other additives. These layers provide a physical barrier between the ink and substrate, with the mordanting agent, often a cationic compound, forming an insoluble complex with the anionic dye to immobilize it while the binder absorbs the solvent. The drying time of inks applied to such substrates is generally limited by the rate of absorption of the solvent by the polymeric binder in combination with the evaporation rate of the solvent.

A wide variety of substrates are used in ink jet printing. Some of these substrates, particularly those used in high quality printing, for example textiles and fine art paper, have specific desirable surface properties (e.g., porosity and texture) which may be unacceptably altered by the application of an ink-receptive surface layer. Without such a surface layer, however, the printed images obtained often exhibit low image density, wide dot spread, loss of sharpness, feathering and show-through.

In the photographic industry, the use of quaternary compounds as mordanting agents for dyes is known. Polymeric quaternaries are mentioned in, e.g., U.S. Pat. Nos. 4,814,255 and 4,463,080, as mordanting materials used in diffusion transfer photography. Mordanting agents have also been used in ink-jet imaging, e.g., as described in U.S. Pat. Nos. 4,554,181, 5,126,010, 5,418,078.

SUMMARY OF THE INVENTION

The invention features, in one aspect, a mordanting substrate including a porous substrate, and a mordanting agent distributed within the substrate, preferably imbibed into the substrate. The mordanting substrate is particularly advantageous for use in ink jet printing, especially for ink jet applications requiring high image quality.

Preferably, the substrate is a fibrous cellulosic material, and the mordanting agent is a cationic organic compound, preferably a cationic polymer that is soluble in polar solvents, e.g., water. The polar solvent solubility of the polymer, in combination with the porosity and cellulosic nature of the material, has been found to cause the mordanting agent, when imbibed into the substrate in the form of a solution, and subsequently dried, to bind to fibers within the substrate. This binding in turn allows excellent immobilization of dye within the substrate.

Because the mordanting agent is distributed within the substrate, rather than being present in a layer on the surface of the substrate, the surface characteristics of the substrate are substantially unchanged by the treatment of the substrate with the mordanting agent. For example, in preferred embodiments the surface porosity of 90# weight, 100% rag fine art paper treated with the mordanting agent of the invention is at least 75% of the surface porosity of the same paper prior to treatment. This is particularly advantageous in applications where the texture and other characteristics are an important feature of the final printed product, e.g., in fine art reproductions and textile printing.

Moreover, the substrate of the invention preferably does not rely on absorption of the ink solvent by a barrier layer to effect drying. Instead, the dye component of the ink is immobilized by the bound mordanting agent and the solvent can then be absorbed by the substrate itself, resulting in virtually instantaneous drying of the ink.

In addition, the solution of mordanting agent may be incorporated into the substrate at any phase of production, for example, during manufacture of the substrate (e.g., the paper making process), after manufacture by the manufacturer of the substrate, or even after manufacture by the end-user of the paper. Because the solution is imbibed, it is not necessary for the end-user to have special coating equipment or take particular care to obtain a uniform coating thickness.

In preferred embodiments, the mordanting agent is provided in the form of a solution or dispersion that is substantially free of any polymer that would be capable of forming a continuous film on the surface of the substrate to be treated, i.e., any polymers contained in the solution or dispersion will not form a continuous film on the substrate surface under the conditions at which the solution is applied to the surface. Thus, substantially all of the mordanting agent will be imbibed into the substrate rather than remaining on the substrate surface. The mordanting agent is more preferably provided in a solution that: consists essentially of the mordanting agent and a solvent, at a low viscosity, in which the mordanting agent is dissolved. Preferred mordanting agents are water soluble, non film-forming cationic organic compounds, preferably cationic polymers, more preferably phospholipids, polyquaternary compounds, more preferably polyquaternary cellulosics, and mixtures thereof. The substrate preferably includes an effective amount of the mordanting agent, defined as an amount which will reduce the mottle of an image applied to the substrate to an observable extent as compared to the same image applied to a control substrate which is the same as the test substrate except that it is untreated, i.e., does not contain the mordanting agent. For the preferred mordanting agents, effective amounts generally are between 1 to 10 $g/m^2$, with 4 to 6 $g/m^2$ being preferred. The concentration of mordanting agent distributed through the substrate is measured by weighing equal volumes of treated and untreated (control) substrates which have been thoroughly dried under the same conditions, the difference in weight being equal to the weight of mordanting agent retained by the treated substrate.

In another aspect, the invention features a method of limiting dot spreading during printing including providing a porous substrate having a mordanting agent distributed within the substrate, and applying a plurality of droplets of ink to the surface of the substrate. The substrate having a mordanting agent distributed within it may be provided by imbibing a substrate with a solution containing the mordanting agent, or by incorporating a mordanting agent into the substrate during manufacture of the substrate.

In preferred embodiments, the droplets of ink are applied by ink jets, and the method further includes allowing the solvent in the ink to be absorbed into the substrate.

In another aspect, the invention features a method of making a substrate for printing, particularly ink jet printing, by providing a porous substrate and imbibing a solution containing a mordanting agent into the substrate.

Preferably, the substrate is a cellulosic material, non or lightly sized, allowing absorption of the solution, and the solution is an aqueous solution. It is also preferred that the solution be substantially free of any polymer capable of forming a continuous film on the surface of the substrate. In preferred embodiments, the porosity of the substrate after imbibition is at least 75% of the porosity prior to imbibition.

In another aspect, the invention features a method of making a mordanting substrate for printing, particularly ink jet printing, by incorporating a mordanting agent into the substrate during manufacture of the substrate. Preferably, the substrate is cellulosic, more preferably paper, and the mordanting agent is incorporated during one of the final wet steps of the paper-making process.

Preferred mordanting agents for use in the above methods are water soluble cationic materials, preferably cationic polymers, more preferably phospholipids, polyquaternary compounds, more preferably polyquaternary cellulosics, and mixtures thereof. The cationic polymers shown to be most effective in this invention have molecular weights in the range of 30,000 to 200,000, but the range may be wider with specific agents.

In another aspect, the invention features a mordanting substrate including a porous substrate, and, as a mordanting agent, a water soluble cationic polymer selected from the group consisting of phospholipids, polyquaternary compounds, and mixtures thereof. Preferably, the mordanting agent comprises a mixture of a phospholipid and a polyquaternary cellulosic polymer. The invention also features a method of limiting dot spreading, feathering and show through during printing including providing this mordanting substrate and applying a plurality of droplets of ink to the surface of the substrate.

The term "distributed within", as used herein, refers to the mordanting agent being present in a region beneath the surface of the substrate, and does not require that the agent be present throughout the substrate. The thickness of the region will depend upon the mordanting agent and dyes used and the properties desired, as would be understood by one skilled in the art.

The term "mordanting agent", as used herein, refers to a mordanting compound or a mixture of several mordanting compounds, i.e., compounds capable of forming an insoluble moiety with a dye to immobilize the dye.

The term "imbibed", as used herein, refers to a process by which a mordanting agent is distributed through the pores of a porous substrate to a region beneath the substrate surface. A simple example of this action is the swelling of paper in water; in this example imbibition of the mordanting agent occurs when the substrate is swelled by a solution or dispersion containing the mordanting agent, carrying the mordanting agent through the pores of the substrate. When imbibition is carried out in this manner, if the substrate is relatively thin, the mordanting agent may be distributed throughout the entire thickness of the substrate, while if the substrate is thick the mordanting agent may be present only in a limited portion of the thickness of the substrate. Preferably, imbibition is accomplished by impregnating, or partially impregnating, the substrate with a solution of the mordanting agent, but the term is meant herein to encompass the same effect achieved by other means, e.g., vapor or vacuum deposition.

Other features and advantages of the invention will be apparent from the description of the preferred embodiment thereof, and from the claims.

DESCRIPTION OF THE PREFERRED EMBODIMENTS

In preferred embodiments, the mordanting substrate includes a porous, cellulosic substrate and a cationically charged polymeric mordanting agent imbibed into the substrate.

Suitable substrates are those which have sufficient porosity, and hydrophilicity (or affinity for the solvent used) to allow the substrate to be imbibed with the mordanting agent. Preferably, the substrate is a fibrous paper or textile material having a Sheffield Porosity of from about 1 to 400 $sec^{-1}$. Preferred substrates include fine art paper and woven fabric, but other porous materials could be used.

Suitable mordanting agents are those which are capable of reacting with dyes used in inks to form a complex that is sufficiently insoluble to substantially immobilize the dyes. For inks containing anionic dyes, a cationic polymer is suitable. Preferred polymers are those that are non-film-forming, i.e., polymers that will not form a continuous film on the substrate surface under the conditions at which the solution is applied to the surface, so that substantially all of the mordanting agent will be imbibed into the substrate rather than remaining on the substrate surface. Imbibition is facilitated by providing the polymer in the form of a solution, preferably an aqueous solution. For optimal results, the solution preferably has a preferred, but not limited to, viscosity of less than about 100 cps and a percent solids level of from about 1 to 10%.

Preferred mordanting agents include, but are not limited to, quaternary ammonium compounds, phospholipids and polyquaternary polymers, more preferably polyquaternary cellulosic polymers. A particularly preferred phospholipid is linoleamidopropylphosphotidyl PG dimoniumchloride, which has the general formula:

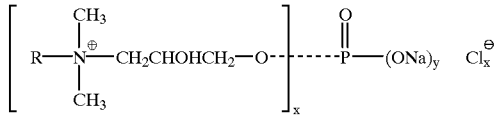

where R=linoleamidopropyl. This phospholipid is commercially available from MONA under the tradename PHOSPHOLIPID EFA. A particularly preferred polyquaternary cellulosic polymer has the general formula:

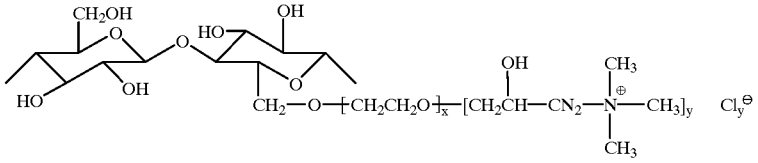

and is commercially available from AMERCHOL under the tradename POLYQUATERNIUM-10.

Generally it is preferred to use a blend of two or more mordanting compounds, so as to be able to form a sufficiently insoluble complex with as many different color dyes as possible. When the preferred mordanting compounds described above are used, preferred ratios are from 10:1 to 1:10 phospholipid to polyquaternium compound, but preferably 8 to 1 to 10 to 1.

The mordant solution may be imbibed into the substrate by soaking, or by any of the recognized coating methods, including but not limited to rod coating, air-knife, reverse roll, or slot application.

The substrate preferably includes an effective amount of the mordanting agent, defined as an amount which will reduce the mottle of an image applied to the substrate to an observable extent as compared to the same image applied to a control substrate which is the same as the test substrate except that it is untreated, i.e., does not contain the mordanting agent. The term "mottle" refers to unintended variation in the saturation of color over a region of the surface of a substrate, as is well known in the printing art. For the preferred mordanting agents, effective amounts generally are between 1 to 10 g/m$^2$, with 4 to 6 g/m$^2$ being preferred. For other mordanting agents, effective and preferred amounts may be outside of these ranges, but may be readily determined empirically. The concentration of mordanting agent distributed through the substrate is measured by weighing equal volumes of treated and untreated (control) substrates which have been thoroughly dried under the same conditions, the difference in weight being equal to the weight of mordanting agent retained by the treated substrate. Whether an effective amount has been retained may be tested by printing an image on the treated substrate and a control substrate and observing whether mottle has been improved by the treatment.

EXAMPLES

The following examples are intended to be illustrative and not limiting in effect.

EXAMPLE 1

A cloth swatch of 60×60 thread mercerized cotton was soaked in a 5% solution of VARISOFT 222 LM quaternary ammonium compound (commercially available from SHEREX), and subsequently hung up to drip dry. The treated textile was then printed on an IRIS 3024 ink-jet printer. The printed image showed substantial improvement over the untreated textile sample. The color space was increased by 30%, the dot spread was more consistent, and the amount of show through was reduced.

EXAMPLE 2

A cloth swatch of 60×60 threads per inch mercerized cotton was imbibed by soaking for two minutes in the following solution: 30 g of a 5% aqueous solution of U-CARE POLYMER JR-125 poly-quaternary compound (commercially available from AMERCHOL), 10 g of a 30% aqueous solution of PHOSPHOLIPID EFA phospholipid (commercially available from MONA), and 160 g deionized water.

The fabric was then dried with warm air and ironed gently to flatten. The resulting textile media was printed on an IRIS 3024 printer, with a sample of untreated 60×60 mercerized cotton printed as a control. The image printed on the treated substrate showed brighter, deeper colors than the image printed on the control substrate. The treated substrate felt substantially the same as the control substrate, i.e., it did not exhibit any stiffness or oily feel. After washing in cold water, the treated sample maintained more color than the control. The color densities were measured using a MACBETH TR 927 densitometer with the following results:

| | Control | Control After wash | Treated | Treated After wash |
|---|---|---|---|---|
| black | 1.35 | 0.99 | 1.39 | 1.20 |
| magenta | 1.29 | 0.90 | 1.35 | 1.21 |
| cyan | 1.20 | 0.81 | 1.29 | 1.15 |

EXAMPLE 3

A sample of ARCHES 140# watercolor paper was rod-coated using a #50 wire-wound rod with the following solution, such that the solution was imbibed into the paper: 10 g of a 3% aqueous solution of PHOSPHOLIPID EFA phospholipid, 20 g. of a 5% aqueous solution of U-CARE POLYMER 30M poly-quaternary compound, and 270 g. deionized water.

The paper was then warm air dried and was printed on, using an IRIS 3047HS printer. An untreated piece of the same paper was printed as a control. The treated paper showed greatly enhanced color with smoother solid areas. The surface of the treated paper felt and looked substantially the same as that of the control paper. The maximum color densities were measured with the following results:

| | Control paper | Treated paper |
|---|---|---|
| Black | 1.37 | 1.57 |
| Magenta | 1.12 | 1.30 |
| Cyan | 0.99 | 1.14 |

Other embodiments are within the claims. For example, non-cellulosic substrates could be used, provided that the substrate is porous, is capable of being imbibed with the mordanting agent, and is capable of being printed with an ink.

In addition, although the preferred embodiment above is directed to cationic mordanting agents for use with anionic dyes, the invention could be practiced with anionic mordanting agents and cationic dyes as well.

What is claimed is:

1. A method of making a mordanting substrate for printing comprising the steps of manufacturing a porous substrate, and incorporating into the porous substrate a mordanting agent comprising a cationic polymer comprising a mixture of a phospholipid and a polyquaternary cellulosic polymer.

2. A mordanting substrate comprising (a) a porous substrate, and, (b) distributed within said substrate, a mordanting agent comprising a mixture of water soluble cationic polymers comprising a mixture of a phospholipid and a polyquaternary cellulosic polymer.

3. The mordanting substrate of claim 2 wherein said porous substrate comprises a fibrous paper or textile material having a Sheffield Porosity of from about 1 to 400 $sec^{-1}$.

4. The mordanting substrate of claim 3 wherein said fibrous paper is a fine art paper.

5. A method of limiting dot spreading during printing comprising the steps of:

providing a substrate including a mordanting agent comprising a mixture of a phospholipid and a polyquaternary cellulosic polymer; and applying a plurality of droplets of ink to the surface of the substrate.

* * * * *